US005303664A

United States Patent [19]

Imai et al.

[11] Patent Number: 5,303,664

[45] Date of Patent: Apr. 19, 1994

[54] THREAD CUTTER WITH THROUGH HOLE AND CUTOUT FOR SEWING MACHINE

[75] Inventors: Tsutomu Imai; Minoru Wada; Takashi Nitto, all of Tokyo, Japan

[73] Assignee: Juki Corporation, Tokyo, Japan

[21] Appl. No.: 943,396

[22] Filed: Sep. 10, 1992

[30] Foreign Application Priority Data

Sep. 13, 1991 [JP] Japan ..... 3-074083

[51] Int. Cl.[5] ..... D05B 65/00

[52] U.S. Cl. ..... 112/292

[58] Field of Search ..... 112/285, 289, 291, 292, 112/294, 296, 297, 298; 83/902

[56] References Cited

U.S. PATENT DOCUMENTS

| | | | |
|---|---|---|---|
| 2,345,943 | 4/1944 | McCann | 112/296 |
| 2,826,160 | 3/1958 | Adams | 112/289 |
| 4,592,297 | 6/1986 | Asano et al. | 112/291 X |
| 5,065,683 | 11/1991 | Hayashi | 112/292 |

FOREIGN PATENT DOCUMENTS

| | | | |
|---|---|---|---|
| 3715603 | 6/1988 | Fed. Rep. of Germany | 112/285 |
| 1100294 | 5/1986 | Japan | 112/285 |
| 7102205 | 8/1197 | Netherlands | 112/298 |
| 0272804 | 8/1970 | U.S.S.R. | 112/296 |

OTHER PUBLICATIONS

Dürkopp-Fadenabschneider, Köhne, Alles Über Fadenabschneider, Sep. 1977, pp. 38-43.

*Primary Examiner*—Clifford D. Crowder
*Assistant Examiner*—Ismael Izaguirre

[57] ABSTRACT

A thread cutting device for a sewing machine includes a stationary blade which is disposed downwardly of a needle plate and a movable blade. The stationary blade is provided at its one end with a cutting edge. The movable blade which is formed with a cutout in the surface opposite to the stationary blade, is adapted to rotate about a shaft and pass over the needle plate and the stationary blade. The cutout is adapted to catch and guide a thread along a path for the thread and provided with a cutting edge to cooperate with the cutting edge of the stationary blade to cut the thread. A through hole is formed between the cutout and the cutting edge of the movable blade to meander the thread through the hole.

3 Claims, 6 Drawing Sheets

THREAD CUTTER WITH THROUGH HOLE AND CUTOUT FOR SEWING MACHINE

FIELD OF THE INVENTION

This invention relates to a thread cutting device for a sewing machine. Particularly, the invention relates to a thread cutter which prevents blades from moving out of position when threads are cut, thereby ensuring a positive thread cutting operation.

BACKGROUND OF THE INVENTION

Thread cutting devices for sewing machines are known in the art. A conventional thread cutting device for the sewing machine which is mounted downwardly of a throat or a needle plate is shown in FIG. 1.

A stationary blade 1 is firmly held in position downwardly of the throat plate and includes at its tip end a knife or cutting edge 2. The cutting edge 2 extends to the vicinity of a needle guide 3 with an opening through which a needle (not shown) passes. A movable blade 4 is connected to a certain drive means or mechanism (not shown) and is so driven about a shaft 5 in the direction of an arrow as to extend across the stationary blade 1. A cutout 7 is formed in the movable blade 4 on the back side thereof as viewed from FIG. 1 to face the stationary blade 1. The cutout 7 is provided at its corner with a circular hole 6 and serves to guide threads (not shown) extending from needle guide 3 along a path. The circular hole 6 is ground and faced to obtain a cutting edge 8.

The conventional thread cutter is structured as aforementioned and reference will be made to the operation thereof shown in FIGS. 2A, 2B, 3A, and 3B.

FIG. 2A shows the thread cutting device in the stand-by position. In this position, the threads 20 (needle and bobbin threads in this instance) are extended from the needle guide 3 to a workpiece.

FIG. 2B shows the thread cutting device in an operative position where the movable blade 4 starts rotating about shaft 5. The movable blade 4 passes over the needle guide 3 to catch the threads 20 and continues to move with the threads 20 in the direction of the stationary blade 1.

FIG. 3A shows the moving blade positioned to extend over the needle guide 3 and the stationary blade 1. The threads 20 are guided along a path for the movable blade 4 by the cutout 7 formed therein.

FIG. 3B shows the threads when cut. The threads 20 run in the cutout 7 are cut in the optimum direction and at the optimum angle by the cutting edges 2, 8 of the stationary and moving blades 1, 4.

The prior art thread cutting device has, however, disadvantages which are described hereinafter with reference to FIGS. 4A and 4B. Threads which are of a diameter larger than the depth of the cutout 7 may occasionally fail to run into the circular ground hole in the cutting edge 8. This occurrence will inadvertently move up the movable blade 4 to thus separate from the stationary blade. FIG. 4A shows the moving blade 4 located to extend over the needle guide 3 and the stationary blade 1. At this moment, the thicker threads 20 are held or clamped between the needle guide 3 and the movable blade 4 or between the stationary blade 1 and the movable blade 4. The larger diameter of the thicker threads 20 raises the movable blade 4 relative to the stationary blade 1. As a result, the cutting edges 2, 8 of the two blades 1, 4 are unable to cross each other in a suitable fashion, resulting in failure in cutting the thicker threads 20. (See FIG. 4B).

SUMMARY OF THE INVENTION

It is, therefore, an object of the invention to overcome the aforementioned disadvantages.

Another object of the present invention is to provide a thread cutting device which is capable of positively and precisely cutting the threads by preventing the movable blade from inadvertently rising.

A further object of the present invention is to provide a thread cutting device which enable the blades to cut off the threads to have an excellent finish.

To achieve the above objects of the present invention, there is provided a thread cutting device which comprises a stationary blade and a movable blade having a through hole dimensioned to allow at least two threads to pass therethrough.

BRIEF DESCRIPTION OF THE DRAWINGS

The invention will be described in greater detail below by way of reference to the following drawings, wherein.

DETAILED DESCRIPTION OF THE DRAWINGS

Figure 1:
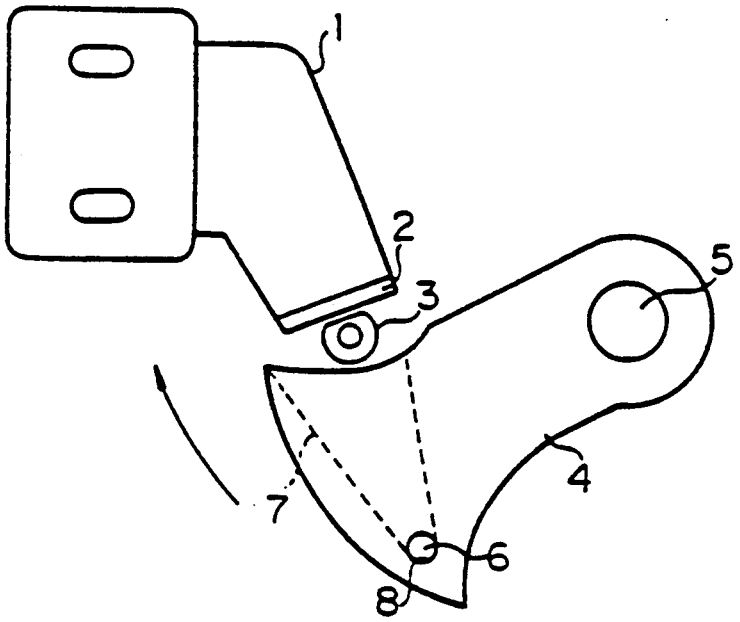
(PRIOR ART) FIG. 1
FIG. 1 is a front view of a conventional thread cutting device for a sewing machine.
Figure 2A:
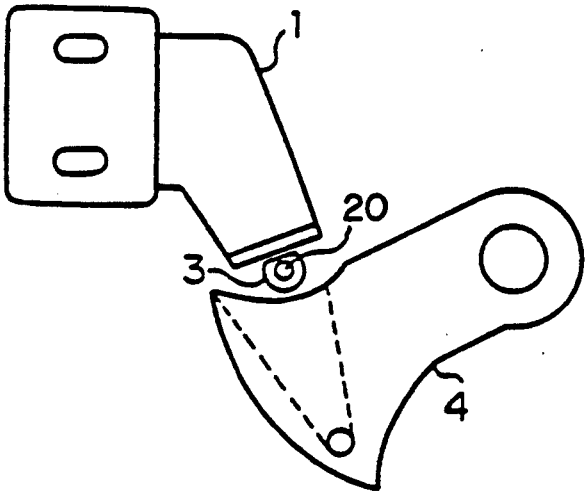
(PRIOR ART) FIG. 2A
FIG. 2A is a representation of the conventional thread cutting device in inoperative position.
Figure 2B:
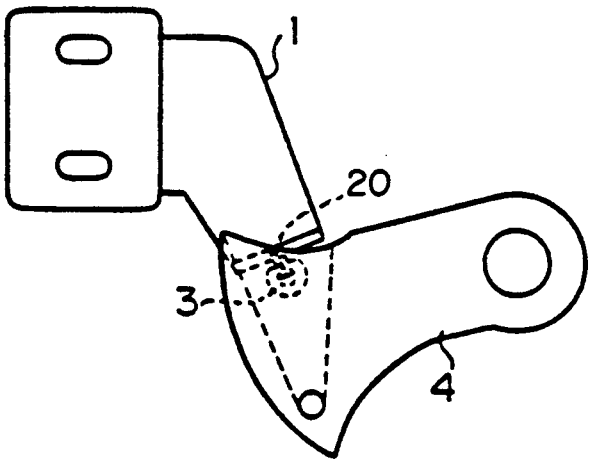
(PRIOR ART) FIG. 2B
FIG. 2B is a view of the movable blade of the cutting device in operative position.
Figure 3A:
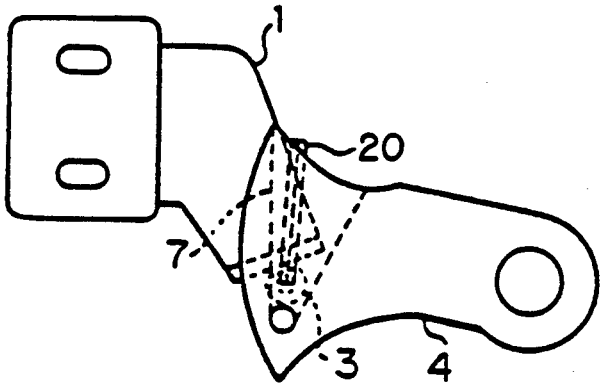
(PRIOR ART) FIG. 3A
FIG. 3A is a representation showing the movable blade positioned to extend over the needle guide and the stationary blade.
Figure 3B:
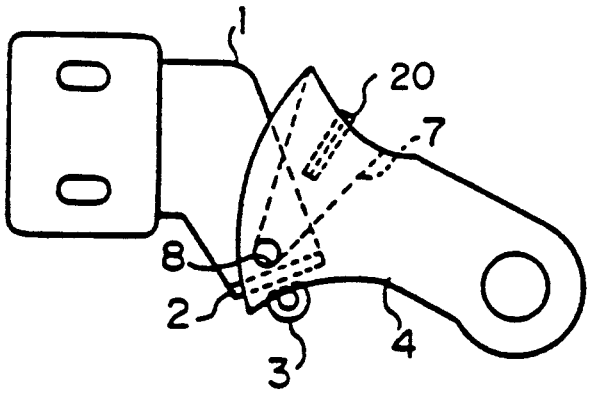
(PRIOR ART) FIG. 3B
FIG. 3B is a view showing the threads as cut.
Figure 4A:
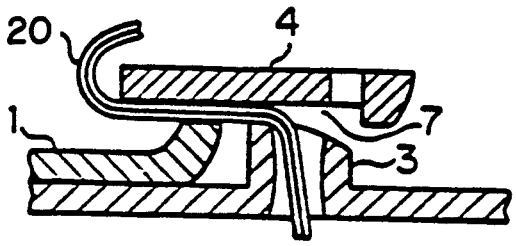
(PRIOR ART) FIG. 4A
FIG. 4A is a representation showing the manner in which the movable blade is raised when the movable blade is laid over the needle guide and the stationary blade.
Figure 4B:
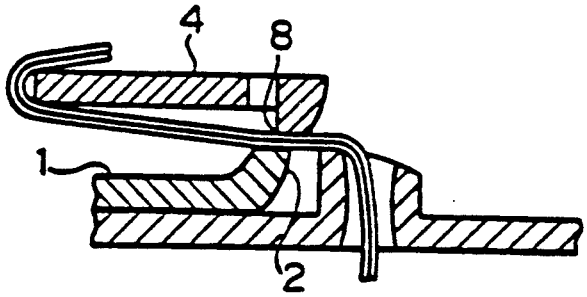
(PRIOR ART) FIG. 4B
FIG. 4B is a view showing the movable blade when involved in failure in cutting the threads when the thread cutting device has been brought into the state shown in FIG. 4A.
Figure 5:
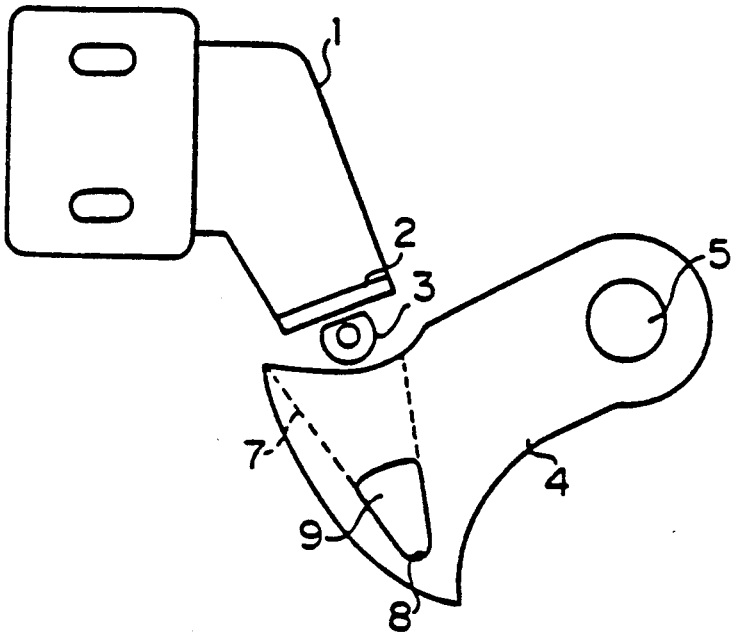
FIG. 5 is a representation schematically showing a thread cutting device embodying the present invention.
Figure 6:
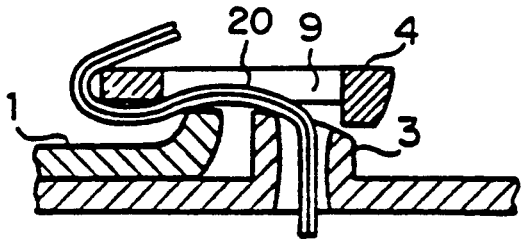
FIG. 6 is a section showing a movable blade positioned to extend over a needle guide and a stationary blade when thread are severed by the thread cutting device shown in FIG. 5.
Figure 7:
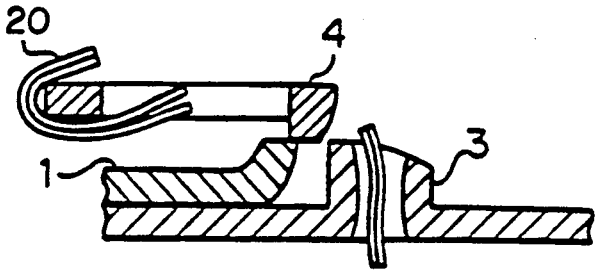
FIG. 7 is a sectional view showing the manner in which the threads are cut by the thread cutting device shown in FIG. 5.

The present invention will be now described by referring to the accompanying drawings, FIGS. 5 through FIG. 7 in which the preferred embodiment of the invention is illustrated. In the drawings, like reference characters used in FIGS. 1 through FIG. 4B designate like or corresponding parts shown in FIGS. 5, 6, and 7. A movable blade 4 has a cutting edge 8 and a through hole 9 formed forwardly of the cutting edge 8. The through hole 9 is dimensioned so that at least two threads can meander and pass therethrough. In the embodiment shown in FIG. 5, the through hole 9 is shaped substantially rounded triangular rather than circular, as in the conventional cutting device of FIG. 1.

Now, a sequential process of thread severing operation performed by the thread cutting device will be explained by referring to FIGS. 5 through 7. FIG. 6 is a sectional view showing the manner in which the movable blade 4 is driven to assume a position where it is located to extend over a needle guide 3 and a stationary blade 1. This will allow the threads 20 (needle and bobbin threads) to meander through the through hole 9 formed in the movable blade 4 to prevent threads from inadvertently raising up the movable blade 4.

The thread cutting device according to the invention is designed to catch the threads in the manner as aforementioned and then meander them through the through hole formed forwardly of the cutting edge of the movable blade which is to be moved in the direction of the stationary blade. The through hole is dimensioned so as to allow at least two threads to meander and pass therethrough to thus prevent the threads from upwardly raising the movable blade 4. This will move the movable blade positively and precisely to sever the threads without fail.

We claim:

1. A thread cutting device for a sewing machine having a needle plate and a needle guide through which thread passes, comprising:

a stationary blade having a cutting edge which is disposed in the vicinity of the needle guide;

a shaft; and a movable blade having a top surface and a bottom surface, and adapted to rotate about the shaft and pass over the needle guide and the stationary blade, the movable blade having a cutting edge, a cutout formed in the bottom surface opposite to the stationary blade adapted to engage the thread passing through the needle guide, and defining a through hole contiguous to the cutout, and the movable blade further being opposable to the needle guide and the cutting edge of the stationary blade when the movable blade is located above the stationary blade.

2. The thread cutting device of claim 1 wherein the through hole is substantially triangular in shape.

3. A thread cutting device for a sewing machine comprising:

a needle plate;

a stationary blade having a cutting edge which is disposed beneath the needle plate and in the vicinity of the needle guide;

a shaft; and a movable blade having a top surface and a bottom surface, and adapted to rotate about the shaft and pass over the needle guide and the stationary blade, the movable blade having a cutting edge, a cutout formed in the bottom surface opposite to the stationary blade adapted to engage the thread passing through the needle guide and to guide the thread on a path, and defining a through hole substantially triangular in shape adapted to allow the thread to meander therethrough;

* * * * *